US008757528B2

(12) United States Patent
Hanrott

(10) Patent No.: US 8,757,528 B2
(45) Date of Patent: Jun. 24, 2014

(54) DEVICE FOR SLAG REMOVAL FROM A COAL GASIFICATION REACTOR

(71) Applicant: Christoph Hanrott, Muenster (DE)

(72) Inventor: Christoph Hanrott, Muenster (DE)

(73) Assignee: UHDE GmbH, Dortmund (DE)

( * ) Notice: Subject to any disclaimer, the term of this patent is extended or adjusted under 35 U.S.C. 154(b) by 0 days.

(21) Appl. No.: 13/861,744

(22) Filed: Apr. 12, 2013

(65) Prior Publication Data

US 2013/0228641 A1 Sep. 5, 2013

Related U.S. Application Data

(60) Division of application No. 13/007,246, filed on Jan. 14, 2011, now Pat. No. 8,424,785, which is a continuation of application No. PCT/EP2009/005058, filed on Jul. 11, 2009.

(30) Foreign Application Priority Data

Jun. 15, 2008 (DE) ..... 10 2008 033 095

(51) Int. Cl.
*B02C 21/00* (2006.01)
*B02C 19/00* (2006.01)

(52) U.S. Cl.
USPC ..... 241/65; 241/101.2

(58) Field of Classification Search
USPC ..... 241/101.2, 62, 65, 79
See application file for complete search history.

(56) References Cited

U.S. PATENT DOCUMENTS

| | | | | |
|---|---|---|---|---|
| 6,264,039 | B1 * | 7/2001 | Chyi | 209/18 |
| 6,612,444 | B2 * | 9/2003 | Craddock et al. | 209/164 |
| 7,621,972 | B2 * | 11/2009 | Mehlhose et al. | 48/210 |
| 8,414,780 | B2 * | 4/2013 | Kowoll et al. | 210/774 |

* cited by examiner

*Primary Examiner* — Faye Francis
(74) *Attorney, Agent, or Firm* — Marshall & Melhorn, LLC

(57) ABSTRACT

A device for removing slag from a coal gasification or synthesis gas production process and a slag water bath is enclosed by the reaction vessel The slag is discharged by means of a lock-type transfer vessel arranged located downstream of the slag bath. A vessel includes an upper and a lower cylindrical section, the upper cylindrical section having a diameter larger than that of the lower cylindrical section and both sections are connected by a tapered section which preferably is conical in shape, the angle of the cone being similar to that of the angle of repose of the slag. A process for removing slag from a coal gasification reactor the process including a discharge of slag from the coal gasification reactor to a transfer vessel which precludes formation of slag incrustations in the transfer vessel is also defined.

10 Claims, 1 Drawing Sheet

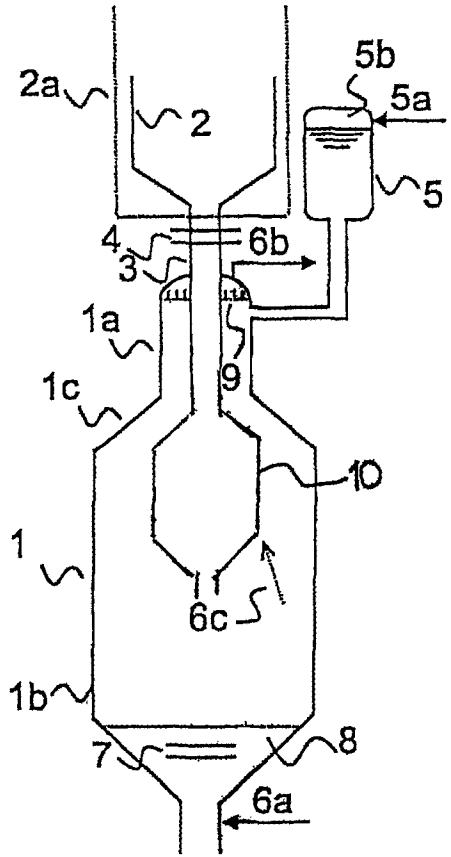
5b
5a
5
2
2a
6b
4
3
9
1a
1c
10
6c
1
1b
7
8
6a

DEVICE FOR SLAG REMOVAL FROM A COAL GASIFICATION REACTOR

CROSS-REFERENCE TO RELATED APPLICATIONS

This application is a divisional application of U.S. Ser. No. 13/007,246, filed Jan. 14, 2011, which was a continuation of International Application PCT/EP2009/005058, which has an International Filing Date of Jul. 11, 2009. U.S. Ser. No. 13/007,246 was pending as of the filing date of this application, and PCT/EP2009/005058 was pending as of the filing date of U.S. Ser. No. 13/007,246, and each of these applications is expressly incorporated by reference as if set forth in their entirety herein.

The invention relates to a device for removing the slag obtained by coal gasification or synthesis gas production. The device is designed such that the slag is first collected in a slag water bath arranged within the pressure vessel. The slag coming from the slag water bath is sent via a lock-type transfer vessel and thus expanded to a lower pressure level. The slag is then conducted across a liquid stream by means of adequate devices in order to avoid any disturbance of the process flow. The invention also relates to a process suited for the production of synthesis gas and for a trouble-free removal of the slag from the respective process.

BACKGROUND OF THE INVENTION

When synthesis gas is produced from carbon-bearing fuel material, the solids obtained normally must be removed from the process. The solids are, for instance, ash and slag, which as a rule are left in the form of lumps and thus cause clogging of the piping, valves or lock-type facilities. DE 3144266 A1 describes such a process, in which the ash and slag obtained by a gasification system are collected in a water bath; the latter is also called slag water bath. The ash and slag particles are batchwise removed by gravity flow from the gasification system by means of a lock-type transfer vessel fitted underneath the said system. In this case, lock-off devices are mounted upstream and downstream of the lock-type transfer vessel so that the said vessel is separated on the fluid side from the gasification system. When the lock-type transfer vessel is filled with slag it is under elevated pressure, too, because it is connected to the gasifier. In order to preclude any blocking of the upper shut-off devices, a downward water stream containing particles is generated and flows across the shut-off devices. This is effected by withdrawing water from the upper section of the lock-type transfer vessel, preferably using a deflector sheet to separate the stream to be discharged in such a manner that only a minor part of particles is entrained by the stream to be discharged.

DE 60031875 T2 deals with a process for slag removal, the slag being obtained by the production of synthesis gas. In this case, a further intermediate vessel is arranged between the gasification device and the lock-type transfer vessel. As a part stream of water with a low particle content is withdrawn from the lock-type transfer vessel, a surge is produced so that the solids are removed from the intermediate vessel and enter the lock-type transfer vessel, thus avoiding any formation of bridging clusters of slag particles. The lock-type transfer vessel must therefore be sized such that the solids can freely settle. In an ideal configuration of the intermediate vessel, devices are mounted so as to provide a part stream of water with low slag content, too, which also improves the settling of slag particles from the gasification system in the intermediate vessel.

EP 0290087 A2 describes a solution suitable for the removal of slag deposits on and clogging of the shut-off devices arranged above the lock-type transfer vessel, i.e. a gas volume is created within the lock-type transfer vessel and subjected to a pressure lower than that of the gasification system. When the lock-type transfer vessel is connected to the gasification system by opening the upper shut-off devices, the difference in pressure initially generates a downward surge impact of water and slag such that any blocking above or upon the upper shut-off devices is eliminated. In this case, the gas volume is arranged in a circular space of the upper section of the lock-type transfer vessel, the said space being formed by the vessel shell and a pipe reaching into the said vessel.

DE 102008005704.5 describes a process for slag removal during the synthesis gas production. The slag is discharged from the coal gasification reactor and sent to a slag vessel with a liquid, which normally is water. The slag vessel is enclosed by the pressure vessel. A lock-type transfer vessel is mounted underneath the slag vessel in direction of gravity and separated from the slag vessel by means of a valve. This method allows a decrease in pressure of the slag flowing into a collecting vessel. A stream of liquid is sent to the circular space formed by the internals. Thus, a downward part stream of the cooling water coming from the slag vessel and containing some slag flows into the lower part of the lock-type transfer vessel, in a counter-current stream to the downward slag movement. In order to enhance the cooling effect, a constriction-type channel is formed by the respective internals such that it is possible to adjust cooling down to a value well under 100° C. and to avoid the formation of vapors during the depressurization of the lock-type transfer vessel. Moreover, a gas volume is arranged in the circular space at a pressure above that of the pressure vessel so that the connection of the lock-type transfer vessel with the pressure vessel causes a backward surge impact required to remove any formation of bridging slag clusters.

DE 102006040077 A1 also describes a process for the removal of slag formed during synthesis gas production. The slag is discharged from the coal gasification reactor and sent to a slag vessel filled with a liquid. A lock-type transfer vessel is arranged in direction of gravity underneath the slag vessel and separated from the latter by means of a valve to discharge the slag. A part stream of liquid is withdrawn from the lock-type transfer vessel and sent to the pressure vessel in order to remove any deposits or blockage from this area. DE 102006040077 A1 shows that the liquid stream is withdrawn at a point of the vessel with a low slag concentration to preclude any entraining of larger slag particles. The cooling water fed to the lower section of the collecting vessel makes a portion of cooling water ascending across the collecting vessel such that the bulky slag is loosened and that the required cooling is achieved before the expansion vessel. Cooling of the slag and water inventory in the vessel is necessary to avoid a formation of vapors during depressurization. The period required for this task depends, inter alia, upon the volume of slag and water in the lock-type transfer vessel.

The processes described above exhibit essential disadvantages. The provisions made for the avoidance of operational trouble during the slag discharge and for loosening blockages require a large dead inventory in the water-filled vessel which consequently cannot be exploited for slag bulking. The dead volume obtained in the described processes may be as large as 50% of the total inventory. The oversize required for the vessels involved causes additional costs for making the lock-type transfer vessels and a large space requirement for integrating them into the plant equipment. Furthermore, the large water inventory in relation to the quantity of slag in fact constitutes a real load for the downstream plant units. In addition, the operational flexibility of the plants is restricted because the dead volume saturated with water must likewise be cooled. This requires additional time and causes prolonged cycle intervals of the lock-type transfer vessel. As a matter of fact, the processes described above merely achieve an undefined separation of coarse and fine particles during the discharge of the liquid stream from the lock-type transfer vessel. Coarser particles unintentionally entrained by the discharged liquid stream may entail an increased erosive load for the downstream equipment, such as piping and pumps, and in the worst case this may cause a shutdown of the complete plant. Furthermore it is not desired to perform a simultaneous discharge of smaller particles still bearing a portion of carbon and of the coarser slag particles. On the contrary, it is common practice to remove the fine particles from the liquid stream in a separate filtration or separation step and to recycle them into the process, if any.

Therefore, an objective of the present invention is to provide a process and device that are suited for an undisturbed removal of slag obtained by the synthesis gas production and to minimize the accumulation of non-useful slag volumes in the lock-type transfer vessel and achieve a high accuracy of separation of fine and coarse particles.

SUMMARY OF THE INVENTION

The present invention addresses this task by a process for the removal of hot slag originating in particular from coal gasification and synthesis gas production, i.e. from a slag water bath housed in a pressure vessel to one or several lock-type transfer vessels provided for the slag and arranged in the direction of gravity flow below the slag water bath, a crushing unit and/or device for bulky storage of the slag being fitted below the said slag bath. A stream of slag and liquid is maintained from the slag bath to the lock-type transfer vessel, and the downward flow of a slag/liquid suspension is reversed in the lock-type transfer vessel. The reversed stream is preferably flowing upwards, in part or in whole, in a circular space preferred in this case and formed by the shell wall and a reversing device. The reversed stream is homogenized over a part of or the whole cross-sectional surface of the intermediate chamber, and the reversal of the slag/liquid suspension and the stream homogenized in the intermediate chamber permit a partial or complete separation of the particles in accordance with grain size or density, the coarser particles settling in the lock-type transfer vessel and the finer particles being entrained by the reversed stream and discharged from the vessel.

A device for the removal of hot slag originating from coal gasification or synthesis gas production, i.e. from a slag water bath housed by a pressure vessel to one or several lock-type transfer vessels provided for the slag and arranged in the direction of gravity below the slag water bath is also disclosed. A crushing unit and/or device for slag bulking is fitted below the slag water bath. A stream of slag-bearing liquid is maintained from the slag bath to the lock-type transfer vessel and at least a part of the liquid stream is withdrawn from the upper section of the lock-type transfer vessel. The lock-type transfer vessel comprises or consists of one upper and one lower cylindrical section. The upper cylindrical section has a diameter smaller than that of the lower cylindrical section, preferably in the range of 0.15 m to an 0.8-fold value of the lower cylindrical section. The upper and lower cylindrical sections are connected via a tapered section. The tapered section is preferably conical with an angle that roughly equals the angle of repose of the slag, hence ranging from 30° to 60°, preferably 45° in relation to the horizontal line.

BRIEF DESCRIPTION OF THE DRAWINGS

The invention is explained in detail on the basis of the attached drawing, and it is noted that the process laid down in this invention is not restricted to the embodiments described in this document.

FIG. 1 shows an embodiment of a system for the removal of slag according to the present invention.

FIG. 1 shows an embodiment of lock-type transfer vessel (1) of coal gasification reactor (2*a*) arranged, in the direction of gravity flow, downstream of the slag water bath (2) of coal gasification reactor (2*a*). A crushing unit (10) is arranged below the slag-water bath and is schematically depicted on the drawing. The withdrawal of slag from slag bath (2), which is controlled via discharge line (3) and valve (4), produces a lower pressure of the slag. Collecting vessel (1) is completely filled with water and consists of two prefabricated cylindrical sections, one upper (1 *a*) and one lower section (1*b*). The two cylindrical sections are connected with each other by means of a pre-fabricated conical and tapered section (1 *c*). Feed vessel for liquid (5) arranged above the water bath is equipped with a pressure line (5*a*) for pressurisation of the gas chamber. Collecting vessel (1) is emptied by gravity flow via a valve (7). Slag (8) is collected in the said collecting vessel (1). The lower section of collecting vessel (1) houses a feeder for coolant (6*a*). The upper section of collecting vessel (1) has a discharge line (6*b*) for liquid with low solids concentration. The upper section of collecting vessel (1) has a device (9) for the homogenization of the liquid stream. Instead of a circular space with gas volume, this embodiment has a feed vessel (5) filled with liquid and a gas chamber (5*b*).

DETAILED DESCRIPTION OF THE PREFERRED EMBODIMENT

It is a beneficial method to carry out the process such that the reversed stream which in whole or in part flows into an intermediate chamber, or preferably an circular space, is sent into the upward direction. Prior to the discharge it is advantageous to homogenise the stream to be withdrawn. This can be done at any convenient place or position. For this purpose, the stream to be discharged is homogenized, for instance, by means of internals or orifice plates. It is a beneficial method to withdraw the liquid stream to be discharged at the vessel top preferably by means of a pump and to return this stream directly or indirectly to the gasifier. As an option, the liquid stream to be discharged and an effluent stream from the gasifier can be discharged simultaneously and thus be expanded to a lower pressure level.

The liquid stream to be withdrawn can easily be expanded to a lower pressure level in the upper zone of the transfer vessel. The removal can likewise be carried out in that zone of the transfer vessel by means of a pump. The liquid stream to be removed can be sent to a loop stream belonging to the pressure vessel of the coal gasification unit, which means that a considerable dead volume of the lock-type transfer vessel can be avoided.

A further beneficial arrangement is to feed the slag-bearing liquid stream via a pipe into the lock-type transfer vessel, the pipe reaching into the transfer vessel. The latter item also serves for the reversal of the liquid stream. For this purpose the slag is fed into that vessel via a pipe reaching into the lock-type transfer vessel.

It is likewise beneficial to feed a liquid stream into the lower section of the said vessel, in this case preferably a coolant. A particular advantage can be achieved if the respective portions of the slag-bearing liquid stream, coolant and stream to be discharged are adjusted in such a manner that the coolant performs an upward flow within the vessel and the slag simultaneously flows downwards in a counter-current. This improves slag cooling and separation of the coarse and fine particles.

One embodiment of the invention provides for a liquid stream to be fed to the lower section of the transfer vessel and the withdrawal of liquid at the top of the said transfer vessel so that a upward flow of the liquid and a simultaneous downflow of the slag is achieved. This enhances the separation of the slag particles and the heat exchange between the coolant and hot slag.

Another benefit can be achieved if the liquid in the lock-type transfer vessel comes into contact with a gas volume housed by a separate collecting vessel subjected to a pressure preferably higher than that of the gasification system and connected to the lock-type transfer vessel by means of a specific piping. Hence, the gas volume can be pressurised at a value higher than that of the gasifier.

The gas volume can be exploited to generate a backward surge impact at the moment when the lock-type transfer vessel is connected with the gasification system in order to remove any blockage or clogging. Moreover, the gas volume can be utilised to replace the hot water remaining in the upper section of the lock-type transfer vessel after filling, by a surge of cold water. A particularly beneficial method is to isolate the separate vessel from the lock-type transfer vessel by means of adequate shut-off devices such that the period required for depressurisation can be dramatically shortened, because the gas volume need not be expanded.

According to one embodiment of the invention, the lock-type transfer vessel consists of two prefabricated cylindrical items of different diameters, the lower piece having a larger diameter than that of the upper piece and the two pieces being linked with each other by a truncated cone tapered in the upward direction. In this embodiment, the feed vessel is connected to the transfer vessel via a piping system. The feed vessel is partly filled with water and holds a gas volume which comes into contact with the liquid via the liquid surface.

The upper cylindrical section of the transfer vessel has a diameter smaller than that of the lower section. The diameter of the upper cylindrical part is preferably 0.15 m and the 0.8 fold of the diameter of the lower cylindrical section. The tapered section forms a cone and has a special advantageous design, i.e. an angle of approx. 45° that is similar to the angle of repose of the slag vis-à-vis the horizontal line.

A specific advantage can be achieved if the liquid stream to be discharged is reversed in the upper section of the lock-type transfer vessel, homogenized by internals and finally discharged. For this purpose the device has internals placed in the top zone of the upper cylindrical part to ensure withdrawal or discharge of the liquid stream. This method permits a distinction between a zone for slag collection and a zone for cooling and separation of the slag particles as well as removal of the liquid stream. The useful volume of slag collection can thus be increased by up to >85%.

The preferred embodiment of the invention encompasses a device for removal of the liquid stream in accordance with the invention and it comprises or consists of valves for reducing the pressure. In accordance with a further embodiment of the invention, the lock-type transfer vessel is equipped with devices which permit a reversal of the liquid stream within the transfer vessel.

A further preferred embodiment of the present invention provides for the lock-type transfer vessel to be equipped with a loop pipeline and a pump, which permits a loop cycle between the transfer vessel and the reaction vessel for coal gasification. According to a further preferred embodiment, the device according to the invention encompasses a separate vessel connected to the transfer vessel via a piping system. Thus, the transfer vessel can be downrated and helps to save costs for the manufacture of the vessel. The separate vessel or the piping belonging to the transfer vessel is preferably equipped with shut-off devices so that it can be isolated from the transfer vessel. In accordance with another embodiment of the invention, the slag vessel has a pipe leaving the latter and forming a crossover to the transfer vessel to feed the slag into it.

The feed vessel is required for water storage and maintenance of the pressure such that lock-type transfer vessel needs no circular space which normally houses a gas volume for eliminating any obstructions. In this case, the a/m function can advantageously be performed by the feed vessel so that no dead volume need be provided for gas in the transfer vessel. An additional benefit of this design is that the shut-off devices fitted between the transfer vessel and the feed vessel permit an isolation of the gas volume from the lock-type transfer vessel. Moreover, this solution also has the advantage that the gas volume housed by the feed vessel need not be expanded during the transfer vessel depressurisation. Furthermore, the water inventory can be used, in conjunction with the gas volume held by the feed vessel, to eliminate any blockages/clogging not only at the beginning of the transfer cycle, but also to replace the hot water in the upper section rapidly and efficiently by cold water at the end of the collection cycle.

Synthesis gas can be produced by, for example, a coal gasification process. The coal gasification reaction takes place in a pressure vessel encompassing a coal gasification reactor, feeding devices for the feedstock and discharge devices for the synthesis gas and the solids obtained. It is a common practice to remove the solids by way of gravity flow from the reactor, which requires that devices for the separation of the solids from the synthesis gas, cooling and discharge of the synthesis gas as well as a device for the collection and removal of the hot slag and ash particles be arranged downstream of the gasifier. This is typically a slag water bath, which is connected to a lock-type transfer vessel in the direction of gravity flow. Downstream of the lock-type transfer vessel, there are devices for purification, drying and discharge of the slag. In order to achieve a trouble-free discharge of the slag, a continuous water stream containing slag is maintained from the slag water bath to the lock-type transfer vessel by means of a branch line from the connected lock-type transfer vessel. For this purpose, the slag-bearing downward water stream is partly or completely reversed within the said lock-type transfer vessel and then it enters, preferably in an upward direction, an intermediate chamber formed by the respective section of the shell and the reversing internals. Prior to the discharge of the water stream from the lock-type transfer vessel, i.e. at the upper end of the intermediate chamber by means of appropriate internals, preferably such as orifice plates, the said stream is homogenised over a part of or the complete cross-sectional surface of the intermediate chamber. Compared to other processes of this type, the said stream homogenisation permits a substantial reduction of the cross-sectional surface and the height of the intermediate chamber as well as an enhanced accuracy of the separation of finer from coarser particles.

There may also be a multiple set of lock-type transfer vessels. According to an embodiment of the invention, two or three transfer vessels are provided for slag collection, including a distribution element in the form of a flat bottom, a spherical ball or a horizontal cylinder, the element being connected to the gasifier outlet and with each other, via a shut-off device, pipeline and/or expansion joints. The fixing elements required for the transfer vessels may be designed as suspension or support type items in the cylindrical or conical section of the slag collecting vessel, with brackets or shell ring supports and/or constant type spring elements that are standard practice in the steel construction and concrete technology.

It is also possible that two or more lock-type transfer vessels for slag collection be linked with two or three gasifier outlets via shut-off devices, pipelines and/or expansion joints. The fixing elements required for the transfer vessels may be designed as suspension or support type items in the cylindrical or conical section of the slag collecting vessel, with brackets or shell ring supports and/or constant type spring elements that are standard practice in the steel construction and concrete technology.

The device in accordance with the present invention can also encompass member units required to operate a coal gasification plant, the collecting vessel and the slag deposing system. Such member parts are, for example, valves, pumps, thermocouples, heaters and, if any, cooling units.

The process for the removal of slag from the synthesis gas production process particularly relates to the coal gasification. However, the process referred to above may also involve other types of process in which the slag removal from the process is effected by gravity flow and in which the slag must not cause clogging of valves or other process equipment.

| Key to referenced items | |
|---|---|
| 1 | Lock-type transfer vessel |
| 1a | Upper cylindrical section of lock-type transfer vessel |
| 1b | Lower cylindrical section of lock-type transfer vessel |
| 1c | Tapered section |
| 2 | Slag (water) bath of a coal gasification reactor |
| 2a | Pressure vessel for the coal gasification reaction |
| 3 | Discharge line for removing the slag from the coal gasification reactor |
| 5 | Coolant feed vessel |
| 5a | Pressure line for feed vessel pressurisation |
| 5b | Gas chamber of the feed vessel |
| 6a | Coolant feed side |
| 6b | Discharge line |
| 6c | Upward flow of liquid stream in the collecting vessel |
| 7 | Slag discharge line |
| 8 | Bulky slag in the collecting vessel |
| 9 | Device for the homogenisation of the mass stream |

The invention claimed is:

1. A device for the removal of hot slag originating from coal gasification or synthesis gas production, comprising:

a pressure vessel for coal gasification housing a slag water bath;

one or more lock transfer vessels connected to the pressure vessel and provided for the slag and arranged in the direction of gravity flow below the slag water bath; and a crushing unit being fitted below the slag water bath, wherein a stream of slag-bearing liquid is conveyed from the slag water bath to the one or more lock transfer vessels by a slag discharge line and at least a part of the slag-bearing liquid stream is withdrawn from the upper section of the one or more lock transfer vessels; wherein the one or more lock transfer vessels comprises one upper and one lower cylindrical section;

the upper cylindrical section having a diameter smaller than that of the lower cylindrical section;

the upper and lower cylindrical sections being connected via a tapered section; and the tapered section having a conical shape, with an angle ranging from 30° to 60°, relative to the horizontal.

2. The device in accordance with claim 1, wherein the diameter of the upper cylindrical section of the transfer vessel is in the range from 0.15 m to the 0.8-fold smaller than the lower cylindrical section.

3. The device in accordance with claim 1, wherein the tapered conical section has an angle of 45° relative to the horizontal.

4. The device in accordance with claim 1, wherein a device for liquid discharge is located in the upper cylindrical section of the transfer vessel.

5. The device in accordance with claim 4, wherein the device for liquid stream discharge comprises one or more valves for pressure reduction.

6. The device in accordance with claim 1, wherein the one or more lock transfer vessels is provided with an internal structure that permits a reversal of the liquid stream within the one or more lock transfer vessels.

7. The device in accordance with claim 1, wherein a separate vessel is included and connected via a piping system with the lock transfer vessel.

8. The device in accordance with claim 7, wherein the separate vessel or the piping system leading to the lock transfer vessel encompass valves which permit a shut-off of the said vessel from the lock transfer vessel.

9. The device in accordance with claim 1, wherein:

two or more lock transfer vessels are provided for slag collection and equipped with a distribution element, chosen from the group consisting of: a flat bottom, a hemispherical ball and a horizontal cylinder;

the distribution element being connected to the outlet of the pressure vessel for gasification by one or more of valves, pipes and/or expansion joints; and fixing elements to provide support in the cylindrical and conical sections of the transfer vessel comprise brackets, shell support rings and constant spring elements.

10. The device in accordance with claim 9, wherein:

two or more lock-type transfer vessels provided for slag collection and connected to two or more outlet nozzles extend from the pressure vessel for gasification and are connected to the two or more transfer vessels.

* * * * *